US008021249B2

(12) United States Patent
Higuchi et al.

(10) Patent No.: US 8,021,249 B2
(45) Date of Patent: Sep. 20, 2011

(54) TWO-PIECE SOLID GOLF BALL

(75) Inventors: Hiroshi Higuchi, Chichibu (JP); Junji Umezawa, Chichibu (JP); Katsunori Sato, Chichibu (JP); Takuma Nakagawa, Chichibu (JP)

(73) Assignee: Bridgestone Sports Co., Ltd., Tokyo (JP)

( * ) Notice: Subject to any disclaimer, the term of this patent is extended or adjusted under 35 U.S.C. 154(b) by 103 days.

(21) Appl. No.: 12/470,242

(22) Filed: May 21, 2009

(65) Prior Publication Data

US 2010/0298070 A1 Nov. 25, 2010

(51) Int. Cl.
*A63B 37/12* (2006.01)

(52) U.S. Cl. ..... 473/384

(58) Field of Classification Search ..... 473/383–385, 473/373, 374

See application file for complete search history.

(56) References Cited

U.S. PATENT DOCUMENTS

| | | | | |
|---|---|---|---|---|
| 5,306,760 | A | 4/1994 | Sullivan | |
| 5,312,857 | A | 5/1994 | Sullivan | |
| 5,601,503 | A * | 2/1997 | Yamagishi et al. | 473/384 |
| 5,782,702 | A | 7/1998 | Yamagishi et al. | |
| 5,782,703 | A | 7/1998 | Yamagishi et al. | |
| 6,726,579 | B2 * | 4/2004 | Ohama et al. | 473/374 |
| 2003/0158312 | A1 | 8/2003 | Chen | |

FOREIGN PATENT DOCUMENTS

| | | | |
|---|---|---|---|
| JP | 5-103846 | A | 4/1993 |
| JP | 10-43342 | A | 2/1998 |
| JP | 10-43343 | A | 2/1998 |
| JP | 2000-107338 | A | 4/2000 |
| WO | 98/46671 | A1 | 10/1998 |

* cited by examiner

*Primary Examiner* — Raeann Gorden

(74) *Attorney, Agent, or Firm* — Sughrue Mion, PLLC

(57) ABSTRACT

The invention provides a two-piece solid golf ball having a core and a cover, which ball has a plurality of dimples formed on the surface. The number of dimples is from 250 to 500, the dimples have a surface coverage (SR) of at least 70% and a volume ratio (VR) of at least 1.0%, and dimples of at least three types are used. In addition, the dimples have an average depth of at least about 0.18 mm and a diameter-to-depth ratio (DM/DP) of not more than about 23. The ball has a coefficient of lift CL at a Reynolds number of 70,000 and a spin ratio of 2,000 rpm which is maintained at 60% or more of the coefficient of lift CL at a Reynolds number of 80,000 and a spin rate of 2,000. This two-piece solid golf ball lowers fluctuations in lift and drag at high and low spin rates, enabling a stable trajectory to be achieved.

10 Claims, 4 Drawing Sheets

DIMPLES IN TABLE 3

DIMPLES IN TABLE 4

DIMPLES IN TABLE 5

DIMPLES IN TABLE 6

DIMPLES IN TABLE 7

TWO-PIECE SOLID GOLF BALL

BACKGROUND OF THE INVENTION

The present invention relates to a two-piece solid golf ball composed of a core and a cover having a surface formed of a plurality of recessed dimples.

With recent advances in golfing equipment such as balls and clubs, it is not unusual for golf balls to be struck under low-spin conditions. However, depending on differences between golfers in the spin rate of a ball struck with a driver, substantial disparities in the distance traveled sometimes arise. To the amateur golfer in particular, because hitting the ball with a driver under low-spin conditions remains a challenge, the outcome is inconsistent—the ball will travel well at times and travel poorly at other times. In addition, when golfing, one has to deal constantly with wind conditions such as tailwinds and headwinds. Accordingly, there exists a desire for the development of golf balls which minimize differences in flight performance under such conditions and increase a player's sense of stability.

A variety of golf balls have already been disclosed which, by optimizing the dimples on the surface of the ball, lower the flight trajectory and hold down decreases in distance.

For example, JP-A 05-103846 describes a golf ball in which the dimple diameter, dimple depth and number of dimples have been optimized. JP-A 10-043342 and JP-A 10-043343 disclose golf balls in which the amount of deformation by a ball when subjected to a load of 100 kg has been set to an appropriate value, the dimple diameter divided by the dimple depth has been set to from 10 to 15, and the dimple space volume as a proportion of the total volume of a hypothetical sphere were the ball to have no dimples on the surface thereof has been set to from 0.7 to 1.1%. JP-A 2000-107338 discloses a practice golf ball in which the ball weight and diameter have been optimized.

However, in the foregoing prior-art golf balls, the dimples have been optimized only for relatively high-spin conditions; the ball trajectory at low spin rates has been less than satisfactory.

It is therefore an object of the present invention to provide a golf ball having dimples which, by lowering fluctuations in lift and drag at high and low spin rates, is able to achieve a stable trajectory.

SUMMARY OF THE INVENTION

The inventors have conducted extensive investigations in order to achieve the above object. As a result, they have found that, in a two-piece solid golf ball composed of a core and a cover, by constructing a golf ball in which even more conditions are imposed on the dimples formed on the ball surface than in the existing art, that is, in which the number of dimples, the dimple surface coverage (SR), the dimple volume ratio (VR), dimple types, the average dimple depth and the dimple diameter DM to depth DP ratio (DM/DP) are specified, in which the ratio between the total number of dimples Da having a diameter of at least 3.7 mm and the total number of dimples Db having a diameter of less than 3.7 mm (total number of Db/total number of Da) is also specified, and in which the ball has a coefficient of lift CL at a Reynolds number of 70,000 and a spin rate of 2,000 rpm that is maintained to at least a given ratio with respect to the ball coefficient of lift CL at a Reynolds number of 80,000 and a spin rate of 2,000, fluctuations in lift and drag at high and low spin rates are smaller and the ball trajectory stabilizes.

Accordingly, the invention provides the following golf balls.

[1] A two-piece solid golf ball comprising a solid core and a cover which encases the core and has formed on an outside surface thereof a plurality of dimples, wherein the solid core has a diameter of from 35 to 44 mm, a deflection when compressed under a final load of 130 kgf from an initial load of 10 kgf of from 2.0 to 6.0 mm, and a surface hardness in Shore D units of from 25 to 65; the cover has a thickness of from 0.5 to 5.0 mm and a material hardness in Shore D units of from 30 to 70; and the number of dimples is from 250 to 500, the dimples have a surface coverage (SR) of at least 70% and a volume ratio (VR) of at least 1.0%, are of at least three types and have an average depth of at least about 0.18 mm and a diameter-to-depth ratio (DM/DP) of not more than about 23; and the ball has a coefficient of lift CL at a Reynolds number of 70,000 and a spin ratio of 2,000 rpm which is maintained at 60% or more of the coefficient of lift CL at a Reynolds number of 80,000 and a spin rate of 2,000.

[2] The two-piece solid golf ball of [1], wherein dimples Da having a diameter of at least 3.7 mm account for at least about 75% of the total dimple volume.

[3] The two-piece solid golf ball of [1] wherein, letting Da represent dimples having a diameter of at least 3.7 mm and Db represent dimples having a diameter of less than 3.7 mm, the ratio (total number of Db)/(total number of Da) is at least about 0.005 and not more than about 1.

BRIEF DESCRIPTION OF THE DIAGRAMS

DETAILED DESCRIPTION OF THE INVENTION

The invention is described more fully below.

Figure 1:
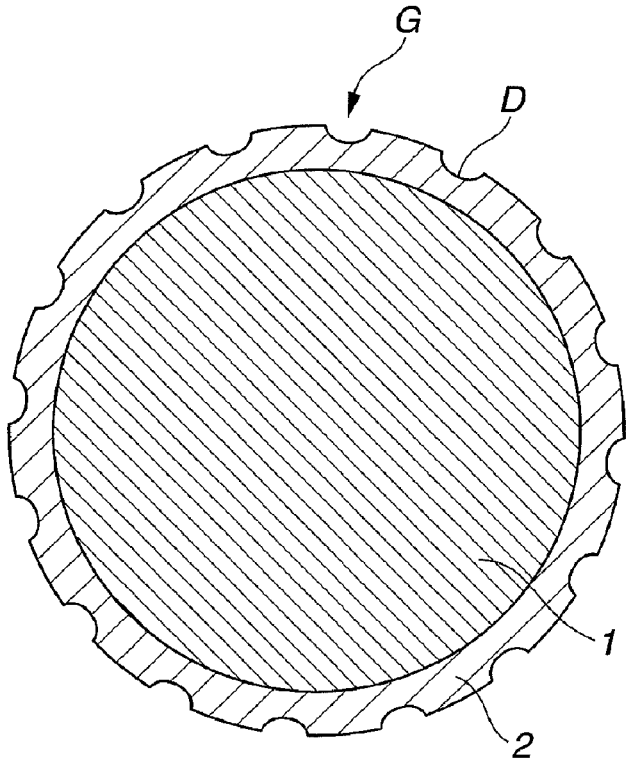
FIG. 1 is a cross-sectional view showing the internal construction of a two-piece solid golf ball according to an embodiment of the present invention.

The golf ball of the invention is a two-piece solid golf ball having a solid core (referred to below as simply the "core") and a cover having a surface formed of a plurality of recessed dimples. By imposing specific conditions on the dimples, fluctuations in lift and drag at high and low spin rates are reduced, enabling a stable trajectory to be achieved. That is, referring to FIG. 1, the present invention is a golf ball G having a two-layer construction composed of a core 1 and a cover 2 encasing the core 1. A plurality of dimples D are formed on the surface of the cover 2, and the dimples satisfy the specific conditions of the invention.

The core in the invention may be formed using a rubber composition containing, for example, a base rubber and also such ingredients as a co-crosslinking agent, an organic peroxide, an inert filler, sulfur and an organosulfur compound. The base rubber of the rubber composition is preferably one composed primarily of a known polybutadiene.

In the present invention, if necessary, an organosulfur compound may be included in the base rubber. In such a case, the amount of organosulfur compound included per 100 parts by weight of the base rubber is preferably at least 0.05 part by weight, more preferably at least 0.1 part by weight, and even more preferably at least 0.2 part by weight, but preferably not more than 5 parts by weight, more preferably not more than 4 parts by weight by weight, and even more preferably not more than 2 parts by weight. If the amount of organosulfur compound included in the core is too small, the core may have too low a rebound, possibly resulting in a low rebound for the ball as well and, in turn, a poor distance. On the other hand, if too much organosulfur compound is included, the core hardness may become too low, resulting in a poor feel when the ball is played and a poor durability to cracking on repeated impact.

The core diameter is set to from 35 to 44 mm, and is preferably at least 37 mm, more preferably at least 39 mm, even more preferably at least 40 mm, and most preferably at least 41 mm. The upper limit in the core diameter is preferably not more than 44 mm, more preferably not more than 43.5 mm, even more preferably not more than 43 mm, and most preferably not more than 42.8 mm. The core has a deflection, when compressed under a final load of 130 kgf from an initial load of 10 kgf, in a range of from 2.0 to 6.0 mm, preferably at least 2.3 mm, more preferably at least 2.7 mm, even more preferably at least 3.0 mm, and most preferably at least 3.3 mm. The upper limit in the core deflection is preferably not more than 5.5 mm, more preferably not more than 5.0 mm, and even more preferably not more than 4.5 mm. If the core is harder than the above range, the spin rate may rise excessively, which is unsuitable for the dimples in the present invention. On the other hand, if the core is softer than the above range, the rebound may be too low, as a result of which the ball may have a poor distance, too soft a feel, and a poor durability to cracking on repeated impact.

The core surface has a hardness, as measured with a type D durometer based on ASTM D2240 (referred to below as "type D durometer hardness"), of from 25 to 65, preferably at least 30, more preferably at least 35, even more preferably at least 40, and most preferably at least 43. The upper limit is preferably not more than 62, more preferably not more than 59, and even more preferably not more than 56. If the core surface is harder than the above range, the spin rate may rise excessively, which is unsuitable for the dimples of the invention. On the other hand, if the core surface is softer than the above range, the rebound may be too low, resulting in a poor distance, the feel on impact may be too soft, and the ball may have a poor durability to cracking on repeated impact.

By using the above material, a golf ball which is able to achieve a stable trajectory can be provided.

Next, the cover used in this invention may be formed of a known material exemplified by thermoplastic resins such as ionomeric resins, and various types of thermoplastic elastomers. Examples of thermoplastic elastomers include polyester-based thermoplastic elastomers, polyamide-based thermoplastic elastomers, polyurethane-based thermoplastic elastomers, olefin-based thermoplastic elastomers and styrene-based thermoplastic elastomers.

A cover material which is composed primarily of a material selected from the group consisting of the polyurethane materials (I), polyurethanes (II) and ionomeric resin materials shown below may be used. These materials, including methods of formation thereof, are described in order below.

Polyurethane Material (I)

This material (I) is a cover-forming material (C) composed primarily of components A and B below:

(A) a thermoplastic polyurethane material, (B) an isocyanate mixture obtained by dispersing (b-1) an isocyanate compound having as functional groups at least two isocyanate groups per molecule in (b-2) a thermoplastic resin that is substantially non-reactive with isocyanate.

In cases where the cover is formed with the above-described cover-forming material (C), a golf ball having a better feel on impact, controllability, cut resistance, scuff resistance and durability to cracking on repeated impact can be obtained.

Next, above components A to C are described.

The thermoplastic polyurethane material (A) has a structure which includes soft segments made of a polymeric polyol (polymeric glycol), and hard segments made of a chain extender and a diisocyanate. Here, the polymeric polyol used as a starting material is not subject to any particular limitation, and may be any that is used in the prior art relating to thermoplastic polyurethane materials, such as polyester polyols and polyether polyols. Polyether polyols are preferable to polyester polyols because they enable the synthesis of thermoplastic polyurethane materials having a high rebound resilience and excellent low-temperature properties. Illustrative examples of polyether polyols include polytetramethylene glycol and polypropylene glycol. Polytetramethylene glycol is especially preferred from the standpoint of the rebound resilience and low-temperature properties. The polymeric polyol has an average molecular weight of preferably from 1,000 to 5,000. A molecular weight of from 2,000 to 4,000 is especially preferred for synthesizing thermoplastic polyurethane materials having a high rebound resilience.

The chain extender employed is preferably one which is used in the art relating to conventional thermoplastic polyurethane materials. Illustrative, non-limiting, examples include 1,4-butylene glycol, 1,2-ethylene glycol, 1,3-butanediol, 1,5-hexanediol and 2,2-dimethyl-1,3-propanediol. These chain extenders have an average molecular weight of preferably from 20 to 15,000.

The diisocyanate employed is preferably one which is used in the art relating to conventional thermoplastic polyurethane materials. Illustrative, non-limiting, examples include aromatic diisocyanates such as 4,4'-diphenylmethane diisocyanate, 2,4-toluene diisocyanate and 2,6-toluene diisocyanate; and aliphatic diisocyanates such as hexamethylene diisocyanate. However, depending on the type of isocyanate, the crosslinking reaction during injection molding may be difficult to control. In the practice of the invention, for stable reactivity with the subsequently described isocyanate mixture (B), it is most preferable to use the following aromatic diisocyanate:

4,4'-diphenylmethane diisocyanate.

A commercial product may be suitably used as the thermoplastic polyurethane material composed of the above-described material. Illustrative examples include Pandex T-8290, Pandex T-8295 and Pandex T8260 (all manufactured by DIC Bayer Polymer, Ltd.), and Resamine 2593 and Resamine 2597 (both manufactured by Dainichi Seika Colour & Chemicals Mfg. Co., Ltd.).

The isocyanate mixture (B) is obtained by dispersing (b-1) an isocyanate compound having as functional groups at least two isocyanate groups per molecule in (b-2) a thermoplastic resin that is substantially non-reactive with isocyanate. Here, the isocyanate compound (b-1) is preferably an isocyanate compound used in the prior art relating to thermoplastic polyurethane materials. Illustrative, non-limiting, examples include aromatic diisocyanates such as 4,4'-diphenylmethane diisocyanate, 2,4-toluene diisocyanate and 2,6-toluene diisocyanate; and aliphatic diisocyanates such as hexamethylene diisocyanate. From the standpoint of reactivity and work safety, the use of 4,4'-diphenylmethane diisocyanate is most preferred.

The thermoplastic resin (b-2) is preferably a resin having a low water absorption and excellent compatibility with thermoplastic polyurethane materials. Illustrative examples of such resins include polystyrene resins, polyvinyl chloride resins, ABS resins, polycarbonate resins, and polyester elastomers (e.g., polyether-ester block copolymers, polyester-ester block copolymers). From the standpoint of the rebound resilience and strength, the use of a polyester elastomer, particularly a polyether-ester block copolymer, is especially preferred.

In the isocyanate mixture (B), it is desirable for the relative proportions of the thermoplastic resin (b-2) and the isocyanate compound (b-1), expressed as the weight ratio (b-2):(b-1), to be within a range of from 100:5 to 100:100, and especially from 100:10 to 100:40. If the amount of the isocyanate compound (b-1) relative to the thermoplastic resin (b-2) is too small, a greater amount of the isocyanate mixture (B) will have to be added to achieve an amount of addition sufficient for the crosslinking reaction with the thermoplastic polyurethane material (A). As a result, the thermoplastic resin (b-2) will exert a large influence, rendering inadequate the physical properties of the cover-forming material (C). On the other hand, if the amount of the isocyanate compound (b-1) relative to the thermoplastic resin (b-2) is too large, the isocyanate compound (b-1) may cause slippage to occur during mixing, making preparation of the isocyanate mixture (B) difficult.

The isocyanate mixture (B) can be obtained by, for example, adding the isocyanate compound (b-1) to the thermoplastic resin (b-2) and thoroughly working together these components at a temperature of from 130 to 250° C. using mixing rolls or a Banbury mixer, then either pelletizing or cooling and subsequently grinding. A commercial product such as Crossnate EM30 (available from Dainichi Seika Colour & Chemicals Mfg. Co., Ltd.) may be suitably used as the isocyanate mixture (B).

The cover-forming material (C) is composed primarily of the above-described thermoplastic polyurethane material (A) and isocyanate mixture (B). In the cover-forming material (C), the isocyanate mixture (B) is included in an amount, per 100 parts by weight of the thermoplastic polyurethane material (A), of at least 1 part by weight, preferably at least 5 parts by weight, and more preferably at least 10 parts by weight, but not more than 100 parts by weight, preferably not more than 50 parts by weight, and more preferably not more than 30 parts by weight. If too little isocyanate mixture (B) is included relative to the thermoplastic polyurethane material (A), a sufficient crosslinking effect will not be achieved. On the other hand, if too much is included, unreacted isocyanate may discolor the molded material.

In addition to the above-described ingredients, other ingredients may be included in the cover-forming material (C). For example, thermoplastic polymeric materials other than the thermoplastic polyurethane material may be included; illustrative examples include polyester elastomers, polyamide elastomers, ionomeric resins, styrene block elastomers, polyethylene and nylon resins. In such a case, thermoplastic polymeric materials other than thermoplastic polyurethane materials may be included in an amount, per 100 parts by weight of the thermoplastic polyurethane material serving as the essential ingredient, of preferably at least 10 parts by weight, but not more than 100 parts by weight, preferably not more than 75 parts by weight, and more preferably not more than 50 parts by weight. The amount is selected as appropriate for such purposes as adjusting the hardness, improving the resilience, improving the flow properties, and improving the adhesion of the cover material. If necessary, various additives such as pigments, dispersants, antioxidants, light stabilizers, ultraviolet absorbers and parting agents may also be suitably included in the cover-forming material (C).

Formation of the cover from the cover-forming material (C) may be carried out by adding the isocyanate mixture (B) to the thermoplastic polyurethane material (A) and dry mixing, then using this mixture to mold a cover over the core with an injection molding machine. The molding temperature varies with the type of thermoplastic polyurethane material (A), although molding is generally carried out within a temperature range of 150 to 250° C.

Reactions and crosslinking which take place in the golf ball cover obtained as described above are believed to involve the reaction of isocyanate groups with hydroxyl groups remaining in the thermoplastic polyurethane material to form urethane bonds, or the creation of an allophanate or biuret crosslinked form via a reaction involving the addition of isocyanate groups to urethane groups in the thermoplastic polyurethane material. Although the crosslinking reaction has not yet proceeded to a sufficient degree immediately after injection molding of the cover-molding material (C), the crosslinking reaction can be made to proceed further by carrying out an annealing step after molding, in this way conferring the golf ball cover with useful characteristics. "Annealing," as used herein, refers to heat aging the cover at a constant temperature for a fixed length of time, or aging the cover for a fixed period at room temperature.

Polyurethane Material (II)

This material (II) is formed of a molded resin blend in which the primary components are (D) a thermoplastic polyurethane and (E) a polyisocyanate compound. By forming a cover composed primarily of such a polyurethane material, an excellent feel on impact, controllability, cut resistance, scuff resistance and durability to cracking on repeated impact can be achieved without a loss of resilience.

The above cover, which is composed primarily of a thermoplastic polyurethane, is formed of a resin blend in which the primary components are (D) a thermoplastic polyurethane and (E) a polyisocyanate compound.

To fully and effectively achieve the objects of the invention, a necessary and sufficient amount of unreacted isocyanate groups should be present within the cover resin material. Specifically, it is recommended that the combined weight of above components (D) and (E) account for at least 60%, and preferably at least 70%, of the total weight of the cover. Above components (D) and (E) are described in detail below.

The above thermoplastic polyurethane (D) is described. The thermoplastic polyurethane structure includes soft segments made of a polymeric polyol (polymeric glycol) that is a long-chain polyol, and hard segments made of a chain extender and a polyisocyanate compound. Here, the long-chain polyol used as a starting material is not subject to any particular limitation, and may be any that is used in the prior art relating to thermoplastic polyurethanes. Exemplary long-chain polyols include polyester polyols, polyether polyols, polycarbonate polyols, polyester polycarbonate polyols, polyolefin polyols, conjugated diene polymer-based polyols, castor oil-based polyols, silicone-based polyols and vinyl polymer-based polyols. These long-chain polyols may be used singly or as combinations of two or more thereof. Of the long-chain polyols mentioned here, polyether polyols are preferred because they enable the synthesis of thermoplastic polyurethanes having a high rebound resilience and excellent low-temperature properties.

Illustrative examples of the above polyether polyol include poly(ethylene glycol), poly(propylene glycol), poly(tetramethylene glycol) and poly(methyltetramethylene glycol) obtained by the ring-opening polymerization of cyclic ethers. The polyether polyol may be used singly or as a combination of two or more thereof. Of the above, poly(tetramethylene glycol) and/or poly(methyltetramethylene glycol) are preferred.

It is preferable for these long-chain polyols to have a number-average molecular weight in a range of 1,500 to 5,000. By using a long-chain polyol having a number-average molecular weight within this range, golf balls made with a thermoplastic polyurethane composition having excellent properties such as resilience and manufacturability can be reliably obtained. The number-average molecular weight of the long-chain polyol is more preferably in a range of 1,700 to 4,000, and even more preferably in a range of 1,900 to 3,000.

As used herein, "number-average molecular weight of the long-chain polyol" refers to the number-average molecular weight calculated based on the hydroxyl number measured in accordance with JIS K-1557.

Any chain extender employed in the prior art relating to thermoplastic polyurethane materials may be advantageously used as the chain extender. For example, low-molecular-weight compounds with a molecular weight of 400 or less which have on the molecule two or more active hydrogen atoms capable of reacting with isocyanate groups are preferred. Illustrative, non-limiting, examples of the chain extender include 1,4-butylene glycol, 1,2-ethylene glycol, 1,3-butanediol, 1,6-hexanediol and 2,2-dimethyl-1,3-propanediol. Of the above, the chain extender is preferably an aliphatic diol having 2 to 12 carbons, and most preferably 1,4-butylene glycol.

Any polyisocyanate compound employed in the prior art relating to thermoplastic polyurethane materials may be advantageously used without particular limitation as the polyisocyanate compound. For example, use may be made of one or more selected from the group consisting of 4,4'-diphenylmethane diisocyanate, 2,4- or 2,6-toluene diisocyanate, p-phenylene diisocyanate, xylylene diisocyanate, 1,5-naphthylene diisocyanate, tetramethylxylene diisocyanate, hydrogenated xylylene diisocyanate, dicyclohexylmethane diisocyanate, tetramethylene diisocyanate, hexamethylene diisocyanate, isophorone diisocyanate, norbornene diisocyanate, trimethylhexamethylene diisocyanate and dimer acid diisocyanate. However, depending on the type of isocyanate, the crosslinking reaction during injection molding may be difficult to control. In the practice of the invention, to provide a balance between stability at the time of production and the properties that are manifested, it is most preferable to use 4,4'-diphenylmethane diisocyanate, which is an aromatic diisocyanate.

It is most preferable for the thermoplastic polyurethane serving as above component D to be a thermoplastic polyurethane synthesized using a polyether polyol as the long-chain polyol, using an aliphatic diol as the chain extender, and using an aromatic diisocyanate as the polyisocyanate compound. It is desirable, though not essential, for the polyether polyol to be a polytetramethylene glycol having a number-average molecular weight of at least 1,900, for the chain extender to be 1,4-butylene glycol, and for the aromatic diisocyanate to be 4,4'-diphenylmethane diisocyanate.

The mixing ratio of active hydrogen atoms to isocyanate groups in the above polyurethane-forming reaction can be adjusted within a desirable range so as to make it possible to obtain a golf ball which is composed of a thermoplastic polyurethane composition and has various improved properties, such as rebound, spin performance, scuff resistance and manufacturability. Specifically, in preparing a thermoplastic polyurethane by reacting the above long-chain polyol, polyisocyanate compound and chain extender, it is desirable to use the respective components in proportions such that the amount of isocyanate groups on the polyisocyanate compound per mole of active hydrogen atoms on the long-chain polyol and the chain extender is from 0.95 to 1.05 moles.

No particular limitation is imposed on the method of preparing the above thermoplastic polyurethane (D). Production may be carried out by either a prepolymer process or a one-shot process in which the long-chain polyol, chain extender and polyisocyanate compound are used and a known urethane-forming reaction is effected. Of these, a process in which melt polymerization is carried out in a substantially solvent-free state is preferred. Production by continuous melt polymerization using a multiple screw extruder is especially preferred.

The thermoplastic polyurethane (D) used in the invention may be a commercial product. Illustrative examples include Pandex T8295, Pandex T8290, Pandex T8260, Pandex T8295 and Pandex T8290 (all manufactured by DIC Bayer Polymer, Ltd.).

Next, concerning the polyisocyanate compound used as above component E, it is essential that, in at least some portion thereof within a single resin blend, all the isocyanate groups on the molecule remain in an unreacted state. That is, polyisocyanate compound in which all the isocyanate groups on the molecule are in a completely free state should be present within a single resin blend, and such a polyisocyanate compound may be present together with a polyisocyanate compound in which a portion of the isocyanate groups on the molecule are in a free state.

Various isocyanates may be used without particular limitation as the polyisocyanate compound. Specific examples include one or more selected from the group consisting of 4,4'-diphenylmethane diisocyanate, 2,4- or 2,6-toluene diisocyanate, p-phenylene diisocyanate, xylylene diisocyanate, 1,5-naphthylene diisocyanate, tetramethylxylene diisocyanate, hydrogenated xylylene diisocyanate, dicyclohexylmethane diisocyanate, tetramethylene diisocyanate, hexamethylene diisocyanate, isophorone diisocyanate, norbornene diisocyanate, trimethylhexamethylene diisocyanate and dimer acid diisocyanate. Of the above group of isocyanates, using 4,4'-diphenylmethane diisocyanate, dicyclohexylmethane diisocyanate and isophorone diisocyanate is preferred for achieving a good balance between the influence on moldability by, for example, the rise in viscosity associated with reaction with the thermoplastic polyurethane serving as component D, and the properties of the resulting golf ball cover material.

A thermoplastic elastomer other than the above-described thermoplastic polyurethane may be included as component F together with above components D and E. Including this component F in the above resin blend enables the flow properties of the resin blend to be further improved and enables various properties required of golf ball cover materials, such as resilience and scuff resistance, to be enhanced.

Component F, which is a thermoplastic elastomer other than the above thermoplastic polyurethane, is exemplified by one or more thermoplastic elastomer selected from among polyester elastomers, polyamide elastomers, ionomeric resins, styrene block elastomers, hydrogenated styrene-butadiene rubbers, styrene-ethylene/butylene-ethylene block copolymers and modified forms thereof, ethylene-ethylene/butylene-ethylene block copolymers and modified forms thereof, styrene-ethylene/butylene-styrene block copolymers and modified forms thereof, ABS resins, polyacetals, polyethylenes and nylon resins. The use of polyester elastomers, polyamide elastomers and polyacetals is especially preferred because the resilience and scuff resistance are enhanced, owing to reactions with isocyanate groups, while at the same time a good manufacturability is retained.

The relative proportions of above components D, E and F are not subject to any particular limitation. However, to fully achieve the advantageous effects of the invention, it is preferable for the weight ratio D:E:F of the respective components to be from 100:2:50 to 100:50:0, and more preferably from 100:2:50 to 100:30:8.

The resin blend is prepared by mixing together component D, component E, and also component F. It is critical to select the mixing conditions such that, of the polyisocyanate compound, at least some polyisocyanate compound is present in which all the isocyanate groups on the molecule remain in an unreacted state. For example, treatment such as mixture in an inert gas (e.g., nitrogen) or in a vacuum state must be furnished. The resin blend is then injection-molded around a core which has been placed in a mold. To smoothly and easily handle the resin blend, it is preferable for the blend to be formed into pellets having a length of 1 to 10 mm and a diameter of 0.5 to 5 mm. Isocyanate groups in an unreacted state remain in these resin pellets; the unreacted isocyanate groups react with component D or component F to form a crosslinked material while the resin blend is being injection-molded about the core, or due to post-treatment such as annealing thereafter.

In addition to the above thermoplastic polyurethane ingredients, various optional additives may be included in the above resin blend. For example, pigments, dispersants, antioxidants, light stabilizers, ultraviolet absorbers, and parting agents may be suitably included.

The melt mass flow rate (MFR) of the resin blend at 210° C. is not subject to any particular limitation. However, to increase the flow properties and manufacturability, the MFR is preferably at least 5 g/10 min, and more preferably at least 6 g/10 min. If the melt mass flow rate of the resin blend is too low, the flow properties decrease, which may cause eccentricity during injection molding and may also lower the degree of freedom in the thickness of the cover that can be molded. The measured value of the melt mass flow rate is obtained in accordance with JIS-k7210 (1999 edition).

The method of molding the cover using the above material may involve feeding the above resin blend to an injection-molding machine and injecting the molten resin blend around the core. Although the molding temperature in this case will vary depending on the type of thermoplastic polyurethane, the molding temperature is generally from 150 to 250° C.

When injection molding is carried out, it is desirable though not essential to carry out molding in a low-humidity environment such as by purging with an inert gas (e.g., nitrogen) or a low-humidity gas (e.g., low dew-point dry air), or by vacuum treating, some or all places on the resin paths from the resin feed area to the mold interior. Illustrative, non-limiting, examples of the medium used for transporting the resin include low-moisture gases such as low dew-point dry air or nitrogen. By carrying out molding in such a low-humidity environment, reaction by the isocyanate groups is kept from proceeding before the resin has been charged into the mold interior. As a result, polyisocyanate in which the isocyanate groups are present in an unreacted state is included to some degree in the resin molded part, thus making it possible to reduce variable factors such as an unwanted rise in viscosity and enabling the real crosslinking efficiency to be enhanced.

Techniques that may be used to confirm the presence of polyisocyanate compound in an unreacted state within the resin blend prior to injection molding about the core include those which involve extraction with a suitable solvent that selectively dissolves out only the polyisocyanate compound. An example of a simple and convenient method is one in which confirmation is carried out by simultaneous thermogravimetric and differential thermal analysis (TG-DTA) measurement in an inert atmosphere. For example, when the resin blend (cover material) used in the invention is heated in a nitrogen atmosphere at a temperature ramp-up rate of 10° C./min, a gradual drop in the weight of diphenylmethane diisocyanate can be observed from about 150° C. On the other hand, in a resin sample in which the reaction between the thermoplastic polyurethane material and the isocyanate mixture has been carried out to completion, a weight drop from about 150° C. is not observed, but a weight drop from about 230 to 240° C. can be observed.

After the resin blend has been molded as described above, its properties as a golf ball cover can be further improved by carrying out annealing so as to induce the crosslinking reaction to proceed further. "Annealing," as used herein, refers to aging the cover in a fixed environment for a fixed length of time.

Ionomeric Resin Material

The ionomeric resin material is a resin mixture containing (a) to (c) below:

(a) from 95 to 50 wt % of an olefin-unsaturated carboxylic acid-unsaturated carboxylic acid ester random copolymer and/or a metal salt thereof, (b) from 0 to 20 wt % of an olefin-unsaturated carboxylic acid random copolymer and/or a metal salt thereof, and (c) from 0 to 50 wt % of a thermoplastic block copolymer composed of a polyolefin crystalline block and a polyethylene/butylene random copolymer.

The olefin-unsaturated carboxylic acid-unsaturated carboxylic acid ester random copolymer and/or a metal salt thereof serving as component (a) has a weight-average molecular weight (Mw) of preferably at least 100,000, more preferably at least 110,000, and even more preferably at least 120,000, but preferably not more than 200,000, more preferably not more than 190,000, and even more preferably not more than 170,000. The weight-average molecular weight (Mw) to number-average molecular weight (Mn) ratio for the copolymer is preferably at least 3, and more preferably at least 4, but preferably not more than 7, and more preferably not more than 6.5.

Above component (a) is an olefin-containing copolymer. The olefin in component (a) is exemplified by olefins in which the number of carbons is at least 2 but not more than 8, and preferably not more than 6. Illustrative examples of such olefins include ethylene, propylene, butene, pentene, hexene, heptene and octene. The use of ethylene is especially preferred.

Illustrative examples of the unsaturated carboxylic acid in component (a) include acrylic acid, methacrylic acid, maleic acid and fumaric acid. Acrylic acid and methacrylic acid are especially preferred.

The unsaturated carboxylic acid ester in component (a) may be, for example, a lower alkyl ester of an unsaturated carboxylic acid. Illustrative examples include methyl methacrylate, ethyl methacrylate, propyl methacrylate, butyl methacrylate, methyl acrylate, ethyl acrylate, propyl acrylate and butyl acrylate. The use of butyl acrylate (n-butyl acrylate, isobutyl acrylate) is especially preferred.

The random copolymer serving as component (a) in the invention may be obtained by the random copolymerization of the above ingredients in accordance with a known method. It is recommended that the unsaturated carboxylic acid content (acid content) within the random copolymer be generally at least 2 wt %, preferably at least 6 wt %, and more preferably at least 8 wt %, but not more than 25 wt %, preferably not more than 20 wt %, and more preferably not more than 15 wt %. At a low acid content, the rebound may decrease, whereas at a high acid content, the material processability may decrease.

The copolymer of component (a) accounts for a proportion of the overall base resin which is from 95 to 50 wt %, preferably at least 60 wt %, more preferably at least 70 wt %, and even more preferably at least 75 wt %, but preferably not more than 92 wt %, more preferably not more than 89 wt %, and most preferably not more than 86 wt %.

The metal salt of the copolymer of component (a) may be obtained by neutralizing some of the acid groups in the random copolymer of component (a) with metal ions.

Examples of the metal ions which neutralize the acid groups include $Na^+$, $K^+$, $Li^{++}$, $Zn^{++}$, $Cu^{++}$, $Mg^{++}$, $Ca^{++}$, $Co^{++}$, $Ni^{++}$ and $Pb^{++}$. Of these, $Na^+$, $Li^+$, $Zn^{++}$,$Mg^{++}$ or $Ca^{++}$ are preferred, and $Zn^{++}$ is especially preferred. The degree of neutralization of the random copolymer by these metal ions, while not subject to any particular limitation, is generally at least 5 mol %, preferably at least 10 mol %, and especially at least 20 mol %, but not more than 95 mol %, preferably not more than 90 mol %, and especially not more than 80 mol %. At a degree of neutralization in excess of 95 mol %, the moldability may decrease. On the other hand, at less than 5 mol %, there arises a need to increase the amount in which the inorganic metal compound serving as component (c) is added, which may present a drawback in terms of cost. Such a neutralization product may be obtained by a known method. For example, the neutralization product may be obtained by introducing a metal ion compound, such as a formate, acetate, nitrate, carbonate, bicarbonate, oxide, hydroxide or alkoxide, into the random copolymer.

Illustrative examples of the olefin-unsaturated carboxylic acid-unsaturated carboxylic acid ester random copolymer serving as component (a) include those available under the trade names Nucrel AN4318, Nucrel AN4319, and Nucrel AN4311 (DuPont-Mitsui Polychemicals Co., Ltd.). Illustrative examples of metal salts of the olefin-unsaturated carboxylic acid-unsaturated carboxylic acid ester random copolymer include those available under the trade names Himilan AM7316, Himilan AM7331, Himilan 1855 and Himilan 1856 (DuPont-Mitsui Polychemicals Co., Ltd.), and those available under the trade names Surlyn 6320 and Surlyn 8120 (E.I. DuPont de Nemours and Co., Ltd.).

In cases where component (b) is blended with the base resin of the above component (a), the olefin-unsaturated carboxylic acid random copolymer and/or metal salt thereof serving as component (b) has a weight-average molecular weight (Mw) of preferably at least 100,000, more preferably at least 110,000, and even more preferably at least 120,000, but preferably not more than 200,000, more preferably not more than 190,000, and even more preferably not more than 170,000. The weight-average molecular weight (Mw) to number-average molecular weight (Mn) ratio for the copolymer is preferably at least 3, and more preferably at least 4, but preferably not more than 7, and more preferably not more than 6.5.

Above component (b) is an olefin-containing copolymer. The olefin in component (b) is exemplified by olefins in which the number of carbons is at least 2 but not more than 8, and preferably not more than 6. Illustrative examples of such olefins include ethylene, propylene, butene, pentene, hexene, heptene and octene. The use of ethylene is especially preferred.

Illustrative examples of the unsaturated carboxylic acid in component (b) include acrylic acid, methacrylic acid, maleic acid and fumaric acid. Acrylic acid and methacrylic acid are especially preferred.

The random copolymer serving as component (b) in the invention may be obtained by the random copolymerization of the above ingredients in accordance with a known method. It is recommended here that the unsaturated carboxylic acid content (acid content) within the random copolymer be generally at least 2 wt %, preferably at least 6 wt %, and more preferably at least 8 wt %, but not more than 25 wt %, preferably not more than 20 wt %, and more preferably not more than 15 wt %. At a low acid content, the rebound may decrease, whereas at a high acid content, the material processability may decrease.

In the above case, the copolymer of component (b) accounts for a proportion of the overall base resin which is 0 wt % or more, and preferably at least 1 wt %, but not more than 20 wt %, preferably not more than 17 wt %, more preferably not more than 10 wt %, even more preferably not more than 8 wt %, and most preferably not more than 5 wt %.

The metal salt of the copolymer of component (b) may be obtained by neutralizing some of the acid groups in the random copolymer of component (b) with metal ions.

Examples of the metal ions which neutralize the acid groups include $Na^+$, $K^+$, $Li^+$, $Zn^{++}$, $Cu^{++}$, $Mg^{++}$, $Ca^{++}$, $Co^{++}$, $Ni^{++}$ and $Pb^{++}$. Of these, $Na^+$, $Li^+$, $Zn^{++}$, $Mg^{++}$ or $Ca^{++}$ are preferred, and $Zn^{++}$ is especially preferred. The degree of neutralization of the random copolymer by these metal ions, while not subject to any particular limitation, is generally at least 5 mol %, preferably at least 10 mol %, and especially at least 20 mol %, but not more than 95 mol %, preferably not more than 90 mol %, and especially not more than 80 mol %. At a degree of neutralization in excess of 95 mol %, the moldability may decrease. On the other hand, at less than 5 mol %, there arises a need to increase the amount in which the inorganic metal compound serving as component (c) is added, which may present a drawback in terms of cost. Such a neutralization product may be obtained by a known method. For example, the neutralization product may be obtained by introducing a metal ion compound, such as a formate, acetate, nitrate, carbonate, bicarbonate, oxide, hydroxide or alkoxide, into the random copolymer.

Illustrative examples of the olefin-unsaturated carboxylic acid random copolymer serving as component (b) include those available under the trade names Nucrel 1560, Nucrel 1525 and Nucrel 1035 (DuPont-Mitsui Polychemicals Co., Ltd.). Illustrative examples of the metal salts of the olefin-unsaturated carboxylic acid random copolymer include those available under the trade names Himilan 1605, Himilan 1601, Himilan 1557, Himilan 1705 and Himilan 1706 (DuPont-Mitsui Polychemicals Co., Ltd.), those available under the trade names Surlyn 7930 and Surlyn 7920 (E.I. DuPont de Nemours and Co., Ltd.), and those available under the trade names Escor 5100 and Escor 5200 (ExxonMobil Chemical).

When component (c) is used, the thermoplastic block copolymer composed of a crystalline polyolefin block and a polyethylene/butylene random copolymer which serves as component (c) is exemplified by thermoplastic block copolymers composed of a crystalline polyethylene block (E) as a hard segment and a block of a relatively random copolymer of ethylene and butylene (EB) as a soft segment. Preferred use may be made of block copolymers having a molecular structure with a hard segment at one or both ends, such as block copolymers having an E-EB or E-EB-E structure.

Such thermoplastic block copolymers composed of a crystalline polyolefin block and a polyethylene/butylene random copolymer which serve as component (c) may be obtained by hydrogenating polybutadiene. A polybutadiene in which bonding within the butadiene structure is characterized by the presence of a block-like 1,4-polymer region having a 1,4-bond content of from 95 to 100 wt %, and in which the butadiene structure as a whole has a 1,4-bond content of from 50 to 100 wt %, and preferably from 80 to 100 wt %, may be advantageously used here as the polybutadiene subjected to hydrogenation. That is, advantageous use may be made of a polybutadiene having a 1,4-bond content of 50 to 100 wt %, and preferably 80 to 100 wt %, and having a block-like 1,4-polymer region with a 1,4-bond content of 95 to 100 wt %

The above-mentioned E-EB-E type thermoplastic block copolymer is preferably one obtained by hydrogenating a polybutadiene having at both ends of the molecular chain 1,4-polymerization products which are rich in 1,4-bonds and having an intermediate region where 1,4-bonds and 1,2-bonds are intermingled. The degree of hydrogenation (conversion of double bonds on the polybutadiene to saturated bonds) in the polybutadiene hydrogenate is preferably from 60 to 100%, and more preferably from 90 to 100%. Too low a degree of hydrogenation may give rise to undesirable effects such as gelation in the blending step with other components such as an ionomer resin and, when the golf ball is formed, may lead to a poor durability to impact.

In the block copolymer having an E-EB or E-EB-E molecular structure with a hard segment at one or both ends that may be preferably used as the thermoplastic block copolymer, the content of the hard segments is preferably from 10 to 50 wt %. If the hard segment content is too high, the cover may lack sufficient softness, making it difficult to effectively achieve the objects of the invention. On the other hand, if the hard segment content is too low, the blend may have a poor moldability.

The thermoplastic block copolymer has a melt index, at 230° C. and under a test load of 21.2 N, of preferably from 0.01 to 15 g/10 min, and more preferably from 0.03 to 10 g/10 min. Outside of this range, problems such as weld lines, sink marks and short shots may arise during injection molding. Moreover, it is preferable for the thermoplastic block copolymer to have a surface hardness of from 10 to 50. If the surface hardness is too low, the golf ball may have a decreased durability to repeated impact. On the other hand, if the surface hardness is too high, blends of the thermoplastic block copolymer with an ionomeric resin may have a decreased rebound. The thermoplastic block copolymer has a number-average molecular weight of preferably from 30,000 to 800,000.

Commercial products may be used as the above-described thermoplastic block copolymer composed of a crystalline polyolefin block and a polyethylene/butylene random copolymer. Illustrative examples include Dynaron 6100P, Dynaron 6200P and Dynaron 6201B available from JSR Corporation. Dynaron 6100P, which is a block polymer having crystalline olefin blocks at both ends, is especially preferred for use in the present invention. These olefinic thermoplastic elastomers may be used singly or as mixtures of two or more thereof.

In cases where component (c) is included in the base resin, the proportion of the overall base resin accounted for by the copolymer serving as component (c) is preferably at least 5 wt %, more preferably at least 8 wt %, even more preferably at least 11 wt %, and most preferably at least 14 wt %, but not more than 50 wt %, preferably not more than 40 wt %, even more preferably not more than 30 wt %, and most preferably not more than 20 wt %.

The ionomeric resin material also includes, mixed therein per 100 parts by weight of above resin components (a) to (c):

(d) from 5 to 170 parts by weight of a fatty acid or fatty acid derivative having a molecular weight of from 280 to 1500; and (e) from 0.1 to 10 parts by weight of a basic inorganic metal compound capable of neutralizing acid groups within component (a), component (d) and, if necessary, component (b).

Next, component (d) is a fatty acid or fatty acid derivative having a molecular weight of at least 280 but not more than 1500 whose purpose is to enhance the flow properties of the heated mixture. It has a molecular weight which is much smaller than those of components (a) to (c), and helps to significantly decrease the melt viscosity of the mixture. Also, because the fatty acid (or fatty acid derivative) of component (d) has a molecular weight of at least 280 but not more than 1500 and has a high content of acid groups (or derivative moieties thereof), its addition to the resin material results in little if any loss of rebound.

The fatty acid or fatty acid derivative serving as component (d) may be an unsaturated fatty acid or fatty acid derivative having a double bond or triple bond in the alkyl moiety, or it may be a saturated fatty acid or fatty acid derivative in which all the bonds in the alkyl moiety are single bonds. It is recommended that the number of carbon atoms on the molecule be preferably at least 18, but preferably not more than 80, and more preferably not more than 40. Too few carbons may result in a poor heat resistance, and may also set the acid group content so high as to cause the acid groups to interact with acid groups present on the base resin, preventing the desired flow-improving effects from being achieved. On the other hand, too many carbons increases the molecular weight, which may significantly lower the flow properties and make the material difficult to use.

Specific examples of fatty acids that may be used as component (d) include stearic acid, 12-hydroxystearic acid, behenic acid, oleic acid, linoleic acid, linolenic acid, arachidic acid and lignoceric acid. Of these, preferred use may be made of stearic acid, arachidic acid, behenic acid, lignoceric acid and oleic acid.

The fatty acid derivative of component (d) is exemplified by derivatives in which the proton on the acid group of the fatty acid has been substituted. Exemplary fatty acid derivatives of this type include metallic soaps in which the proton has been substituted with a metal ion. Metal ions that may be used in such metallic soaps include $Li^{+}$, $Ca^{++}$, $Mg^{++}$, $Zn^{++}$, $Mn^{++}$, $Al^{+++}$, $Ni^{++}$, $Fe^{++}$, $Fe^{+++}$, $Cu^{++}$, $Sn^{++}Pb^{++}$ and $Co^{++}$. Of these, $Ca^{++}$, $Mg^{++}$ and $Zn^{++}$ are especially preferred.

Specific examples of fatty acid derivatives that may be used as component (d) include magnesium stearate, calcium stearate, zinc stearate, magnesium 12-hydroxystearate, calcium 12-hydroxystearate, zinc 12-hydroxystearate, magnesium arachidate, calcium arachidate, zinc arachidate, magnesium behenate, calcium behenate, zinc behenate, magnesium lignocerate, calcium lignocerate and zinc lignocerate. Of these, magnesium stearate, calcium stearate, zinc stearate, magnesium arachidate, calcium arachidate, zinc arachidate, magnesium behenate, calcium behenate, zinc behenate, magnesium lignocerate, calcium lignocerate and zinc lignocerate are preferred.

In the present invention, the amount of component (d) used per 100 parts by weight of the base resin is at least 5 parts by weight, preferably at least 20 parts by weight, more preferably at least 50 parts by weight, and even more preferably at least 85 parts by weight, but not more than 170 parts by weight, preferably not more than 150 parts by weight, even more preferably not more than 130 parts by weight, and most preferably not more than 110 parts by weight.

Use may also be made of known metallic soap-modified ionomers (see, for example, U.S. Pat. No. 5,312,857, U.S. Pat. No. 5,306,760 and International Disclosure WO 98/46671) when using above components (a) and (b).

Component (e) is a basic inorganic metal compound capable of neutralizing the acid groups in above component (a), component (d) and, if necessary, component (b). When, as illustrated in the prior-art examples, components (a), (b) and (d) alone, and in particular a metal-modified ionomeric resin alone (e.g., a metal soap-modified ionomeric resin of the type mentioned in the foregoing patent publications, alone), are heated and mixed, as mentioned below, the metallic soap and unneutralized acid groups present on the ionomer undergo exchange reactions, generating a fatty acid. Because the fatty acid has a low thermal stability and readily vaporizes during molding, it causes molding defects. Moreover, if the fatty acid thus generated deposits on the surface of the molded material, it substantially lowers paint film adhesion. Component (e) is included so as to resolve such problems.

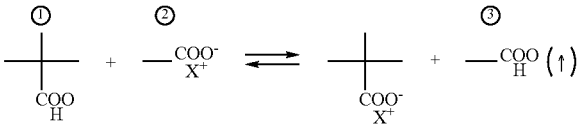

(1) unneutralized acid group present on the ionomer resin
(2) metallic soap
(3) fatty acid
X: metal cation As described above, the foregoing heated mixture thus includes, as component (e), a basic inorganic metal compound which neutralizes the acid groups present in above components (a), (b) and (d). The inclusion of component (e) as an essential ingredient confers excellent properties. Namely, the acid groups in above components (a), (b) and (d) are neutralized, and synergistic effects from the inclusion of each of these components increase the thermal stability of the heated mixture while at the same time conferring a good moldability, and also enhance the rebound of the golf ball.

It is recommended that above component (e) be a basic inorganic metal compound—preferably a monoxide or hydroxide—which is capable of neutralizing acid groups in above components (a), (b) and (d). Because such compounds have a high reactivity with the ionomeric resin and the reaction by-products contain no organic matter, the degree of neutralization of the heated mixture can be increased without a loss of thermal stability.

The metal ions used here in the basic inorganic metal compound are exemplified by $Li^{+}Na^{+}K^{+}$, $Ca^{++}$, $Mg^{++}$, $Zn^{++}$, $Al^{+++}Ni^{+}$, $Fe^{++}$, $Fe^{+++}$, $Cu^{++}$, $Mn^{++}$, $Sn^{++}$, $Pb^{++}$ and $Co^{++}$. Illustrative examples of the inorganic metal compound include basic inorganic fillers containing these metal ions, such as magnesium oxide, magnesium hydroxide, magnesium carbonate, zinc oxide, sodium hydroxide, sodium carbonate, calcium oxide, calcium hydroxide, lithium hydroxide and lithium carbonate. As noted above, a monoxide or hydroxide is preferred. The use of magnesium oxide or calcium hydroxide, which have high reactivities with ionomer resins, is especially preferred.

Component (e) is included in an amount, per 100 parts by weight of the above base resin, of from 0.1 to 10 parts by weight, preferably at least 0.5 part by weight, more preferably at least 0.8 part by weight, and even more preferably at least 1 part by weight, but preferably not more than 8 parts by weight, more preferably not more than 5 parts by weight, and even more preferably not more than 4 parts by weight.

The above-described heated mixture which is obtained by blending components (a) to (e) can be provided with improved thermal stability, moldability and resilience. To this end, it is recommended that, in all the above heated mixtures, at least 70 mol %, preferably at least 80 mol %, and more preferably at least 90 mol %, of the acid groups in the mixture be neutralized. A high degree of neutralization more reliably suppresses the exchange reactions that pose a problem in the above-described cases where components (a) and (b) and the fatty acid (or fatty acid derivative) alone are used, thus making it possible to prevent the generation of fatty acids. As a result, a material can be obtained which has a markedly increased thermal stability, a good moldability, and a substantially higher resilience than conventional ionomeric resins.

Here, with regard to neutralization of the above heated mixture, to more reliably achieve both a high degree of neutralization and good flow properties, it is recommended that the acid groups in the heated mixture be neutralized with transition metal ions and with alkali metal and/or alkaline earth metal ions. Because transition metal ions have a weaker ionic cohesion than alkali metal and alkaline earth metal ions, it is possible in this way to neutralize some of the acid groups in the heated mixture and thus enable the flow properties to be significantly improved.

Various additives may also be optionally included in the above heated mixture. Additives which may be used include pigments, dispersants, antioxidants, ultraviolet absorbers and optical stabilizers. Moreover, to improve the feel of the golf ball on impact, the resin composition may also include, in addition to the above essential ingredients, various non-ionomeric thermoplastic elastomers. Illustrative examples of such non-ionomeric thermoplastic elastomers include styrene-based thermoplastic elastomers, ester-based thermoplastic elastomers and urethane-based thermoplastic elastomers. The use of styrene-based thermoplastic elastomers is especially preferred.

The method of preparing the heated mixture is exemplified by mixture under heating at a temperature of between 150 and 250° C. in an internal mixer such as a twin-screw extruder, a Banbury mixer or a kneader. The method of forming the cover using the heated mixture is not subject to any particular limitation. For example, the cover may be formed by injection molding or compression molding the heated mixture. When injection molding is employed, the process may involve placing a prefabricated core at a given position in the injection mold, then introducing the above material into the mold. When compression molding is employed, the process may involve producing a pair of half cups from the above material, covering the core with these half-cups, then applying pressure and heat within a mold. If molding under heat and pressure is carried out, the molding conditions may be a temperature of from 120 to 170° C. and a period of from 1 to 5 minutes.

The cover material used in the invention need not be selected from the above-described polyurethane material (I), polyurethane material (II) and ionomeric resin material. However, from the standpoint of balance with the subsequently described dimple configuration, the use of the above urethane material (II) is especially preferred.

The cover thickness in the invention is set to a range of from 0.5 to 5.0 mm. It is recommended that the cover thickness be preferably at least 0.6 mm, more preferably at least 0.8 mm, even more preferably at least 1.0 mm, and most preferably at least 1.2 mm, but preferably not more than 4.0 mm, more preferably not more than 3.0 mm, even more preferably not more than 2.0 mm, and most preferably not more than 1.8 mm. If the cover is too thin, the durability will worsen and cracking will tend to arise. On the other hand, if the cover is too thick, the feel on impact may worsen.

In the invention, the cover has a material hardness which is set in a Shore D hardness range of from 30 to 70, and is preferably at least 35, more preferably at least 40, even more preferably at least 45, and most preferably at least 50, but preferably not more than 65, more preferably not more than 62, and even more preferably not more than 59. At a low Shore D hardness, the rebound decreases, reducing the distance of the ball. On the other hand, if the Shore D hardness is too high, the ball will have a hard feel on impact. The cover may thus have a Shore D hardness which is lower than in the prior art, enabling the controllability to be further increased without a loss of rebound.

The following dimple parameters (1) to (8) are provided in the present invention. In cases where, following formation of the cover, etc., the ball surface is subjected to finishing treatment (e.g., finishing treatment such as painting and stamping) or the like, these parameters are calculated based on the shapes of dimples on the final golf ball product in which all such treatment has been completed.

Dimple Parameter (1)

Numerous dimples are formed on the surface of the cover. The number of dimples here is set to at least 250 but not more than 500, with the lower limit being preferably at least 280, more preferably at least 300, and even more preferably at least 340, and the upper limit being preferably not more than 450, more preferably not more than 420, and even more preferably not more than 400. In this range, the golf ball readily incurs lift, enabling the ball to travel farther, particularly on shots with a driver.

Dimple Parameter (2)

To improve aerodynamic performance, it is critical for the dimple surface coverage (SR), defined as the sum of the surface areas on a hypothetical sphere that are circumscribed by the edges of the respective dimples as a proportion of the surface area of the hypothetical sphere, to be at least 70%.

Dimple Parameter (3)

To improve the aerodynamic performance, it is critical for the dimple volume ratio (VR), defined as the sum of the volumes of individual dimple spaces below a flat plane circumscribed by the edge of each dimple on a golf ball as a proportion of the volume of the golf ball were it to have no dimples on the surface (hypothetical sphere), to be at least 1.0%, preferably at least 1.1%, more preferably at least 1.15%, and even more preferably at least 1.2%, but preferably not more than 1.5%, more preferably not more than 1.4%, and even more preferably not more than 1.3%.

Dimple Parameter (4)

The dimples of the present invention are of at least three types, preferably at least four types, and more preferably at least five types, but preferably not more than 14 types, of mutually differing diameter and/or depth. The number of types of dimples is selected as appropriate in this way so as to facilitate an increase in the surface coverage SR specified in the invention.

Dimple Parameter (5)

Figure 2:
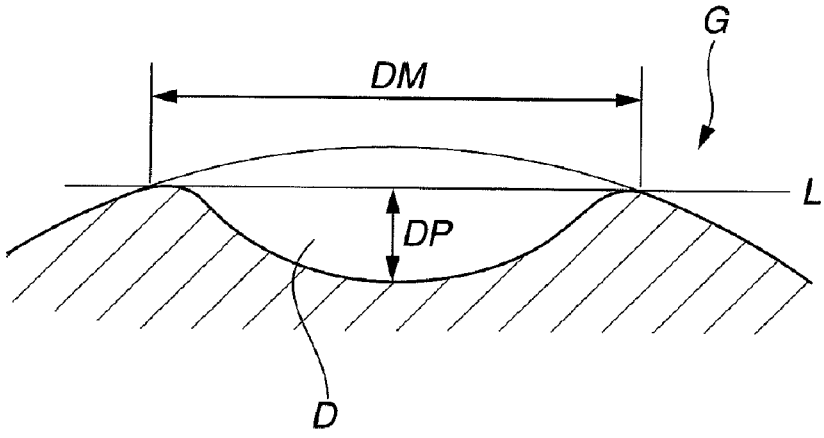
FIG. 2 is a schematic view illustrating a dimple used in the present invention.

"Average dimple depth" refers to the average of the depths of all the dimples. To obtain a proper trajectory, the average dimple depth is set to at least about 0.18 mm, and preferably at least 0.19 mm, but not more than about 1.0 mm, preferably not more than about 0.7 mm, more preferably not more than about 0.5 mm, and even more preferably not more than about 0.3 mm. Referring to FIG. 2, the depth DP of a dimple is measured by connecting the positions where the dimple meets land areas to trace a hypothetical flat plane L and determining the vertical distance from a center position on the flat plane L to the bottom (deepest position) of the dimple.

The average dimple diameter DM, while not subject to any particular limitation, is preferably at least about 3.0 mm, more preferably at least about 3.2 mm, and even more preferably at least about 3.5 mm, but preferably not more than about 7.5 mm, more preferably not more than about 6.5 mm, and even more preferably not more than about 6 mm. "Average dimple diameter DM" refers to the average of the diameters of all the dimples. The dimple diameter DM is measured by determining, as shown in FIG. 2, the diameter (span) DM between positions where the dimple portion is tangent with land areas (non-dimple forming portions), i.e., between the high points of the dimple portion. In most cases, the golf ball has been painted. In such balls, the dimple diameter and depth are determined after the coat of paint has been applied.

Dimple Parameter (6)

The ratio of the dimple diameter to the dimple depth, or DM/DP, has an average value of not more than about 23, preferably not more than about 22, more preferably not more than about 21, and even more preferably not more than about 20. The lower limit, while not subject to any particular limitation, is preferably at least about 5, more preferably at least about 8, even more preferably at least about 10, and most preferably at least about 12.

Dimple Parameter (7)

When the dimples are divided into dimples Da having a diameter of 3.7 mm or more, and smaller dimples Db, the (total number of Db)/(total number of Da) ratio, although not subject to any particular limitation, is preferably set to at least about 0.005 but not more than about 1. The lower limit is more preferably at least about 0.01, even more preferably at least about 0.1, and most preferably at least about 0.2, and the upper limit is more preferably not more than about 0.8, even more preferably not more than about 0.6, and most preferably not more than about 0.5.

The dimples Da having a diameter of at least 3.7 mm account for a proportion of the total dimple volume which, while not subject to any particular limitation, is preferably at least about 75%, more preferably at least about 78%, and even more preferably at least about 80%. The upper limit value is preferably not more than about 98%, more preferably not more than about 95%, and even more preferably not more than about 92%.

The average diameter (Dm) of the Da dimples is preferably at least about 3.7 mm, and more preferably at least about 3.8 mm, but preferably not more than about 7 mm, and more preferably not more than about 6 mm. The average depth (Dp) of the Da dimples is preferably at least about 0.05 mm, and more preferably at least about 0.1 mm, but preferably not more than about 0.5 mm, and more preferably not more than about 0.3 mm. The average volume of the Da dimples is preferably at least about 0.8 $mm^3$, and more preferably at least about 1.0 $mm^3$, but preferably not more than about 3.0 $mm^3$, and more preferably not more than about 2.5 $mm^3$. The ratio Dm/Dp for the Da dimples is preferably at least about 7, and more preferably at least about 8, but preferably not more than about 25, and more preferably not more than about 23. If the above numerical value ranges are not satisfied, sufficient aerodynamic properties cannot be obtained, as a result of which it will not be possible to achieve a good distance and a stable trajectory.

The average diameter (Dm) of the Db dimples is preferably at least about 1 mm, and more preferably at least about 2 mm, but preferably not more than about 3.7 mm, and more preferably not more than about 3.5 mm. The average depth (Dp)

of the Db dimples is preferably at least about 0.05 mm, and more preferably at least about 0.1 mm, but preferably not more than about 0.3 mm, and more preferably not more than about 0.2 mm. The average volume of the Db dimples is preferably at least about 0.2 $mm^3$, and more preferably at least about 0.3 $mm^3$, but preferably not more than about 1.5 $mm^3$, and more preferably not more than about 1.0 $mm^3$. The ratio Dm/Dp for the Db dimples is preferably at least about 10, and more preferably at least about 12, but preferably not more than about 30, and more preferably not more than about 26. If the above numerical value ranges are not satisfied, sufficient aerodynamic properties cannot be obtained, as a result of which it will not be possible to achieve a good distance and a stable trajectory.

Dimple Parameter (8)

To improve the distance a golf ball travels, it is desirable for the ball to have a low coefficient of drag (CD) under high-velocity conditions and a high coefficient of lift (CL) under low-velocity conditions. Thus, with regard to the low-velocity CL, it is critical for the coefficient of lift CL when the ball is launched using an Ultra Ball Launcher (UBL) at a Reynolds number of 70,000 and a spin rate of 2,000 rpm to be maintained at 60% or more, and preferably at 65% or more, of the coefficient of lift CL at a Reynolds number of 80,000 and a spin rate of 2,000.

The dimple shapes are not subject to any particular limitation, and may be, for example, circular, polygonal, tear-shaped, oval or noncircular. Setting the number of dimple types to at least three, and preferably at least five, makes it possible for the dimples to cover at least a given proportion of the spherical surface. By interspersing large and small dimples, the surface coverage can be increased to the specified range. Because this makes it possible to suppress extreme fluctuations in the coefficient of lift CL within the low-velocity region, a ball trajectory stabilizing effect is achieved.

Ball properties such as overall weight and diameter of the two-piece golf ball of the invention may be suitably set according to the Rules of Golf. The ball may generally be formed so as to have a diameter of not less than 42.67 mm and a weight of not more than 45.93 g.

As described above, the two-piece solid golf ball of the invention reduces fluctuations in lift and drag at high and low spin rates, enabling a stable trajectory and distance to be achieved.

EXAMPLES

The following Examples and Comparative Examples are provided by way of illustration and not by way of limitation.

Examples 1 to 3, Comparative Examples 1 to 5

Core compositions formulated as shown below were prepared, then molded and vulcanized to produce solid cores.

The core compositions were formulated as shown below. These rubber compositions were molded and vulcanized for 15 minutes at 155° C., thereby producing cores for the examples of the invention and each of the comparative examples. The core properties are shown in Table 1 below. Numbers in the table indicate parts by weight.

TABLE 1

| | A | B | C | D |
|---|---|---|---|---|
| Polybutadiene rubber | 100 | 100 | 100 | 100 |
| Zinc acrylate | 29.0 | 24.0 | 23.0 | 43.0 |

TABLE 1-continued

| | A | B | C | D |
|---|---|---|---|---|
| Peroxide (1) | 0.3 | 0.6 | 0.3 | 0.3 |
| Peroxide (2) | 0.3 | 0.6 | 0.3 | 0.3 |
| Zinc oxide | 4 | 24 | 4 | 4 |
| Barium sulfate | 8.9 | 0.0 | 12.6 | 2.4 |
| Zinc stearate | 5 | 5.0 | 5 | 5 |
| Antioxidant | 0.1 | 0.1 | 0.1 | 0.1 |
| Zinc salt of pentachlorothiophenol | 0.2 | 1 | 1 | 0 |

Trade names of the materials in the table are as follows.

Polybutadiene rubber: Available from JSR Corporation under the trade name "BR 730"; prepared with a neodymium catalyst; cis-l,4-bond content, 96 wt %; Mooney viscosity, 55; molecular weight distribution: 3.

Zinc acrylate: Available from Nihon Jyoryu Kogyo Co., Ltd.

Peroxide (1): Dicumyl peroxide; available under the trade name "Percumyl D" from NOF Corporation.

Peroxide (2): 1,1-Bis(t-butylperoxy)cyclohexane; available under the trade name "Perhexa C-40"from NOF Corporation.

Zinc oxide: Available from Sakai Chemical Industry Co., Ltd.

Zinc stearate: Available under the trade name "Zinc Stearate G" from NOF Corporation.

Barium sulfate: Available under the trade name "Precipitated Barium Sulfate 100" from Sakai Chemical Industry Co., Ltd.

Calcium carbonate: Available under the trade name "Silver-W" from Shiraishi Calcium Kaisha, Ltd.

Antioxidant: Available under the trade name "Nocrac NS-6" from Ouchi Shinko Chemical Industry Co., Ltd.

Next, the cover material shown in Table 2 below was injection molded over the above core, thereby obtaining a two-piece solid golf ball in which the core is encased with a cover of a given thickness.

The resin blend of cover material F in the table was obtained by kneading the respective starting materials shown in the table (units: parts by weight) in a twin-screw extruder under a nitrogen atmosphere to give a resin blend in which there remained unreacted isocyanate groups. This resin blend was then formed into pellets having a length of 3 mm and a diameter of 1 to 2 mm.

TABLE 2

| Cover material (pbw) | E | F |
|---|---|---|
| Himilan 1557 | 42.5 | |
| Himilan 1601 | 42.5 | |
| Pandex T8290 | | 100 |
| Nucrel AN4318 | 15 | |
| Polyisocyanate compound | | 9 |
| Thermoplastic elastomer | | 15 |
| Titanium oxide | 4.8 | 3.5 |
| Polyethylene wax | | 1.5 |

Trade names of the materials in the table are as follows.

Trade name "Himilan": Ionomeric resins available from DuPont-Mitsui Polychemicals Co., Ltd.

Trade name "Pandex T8290": An MDI-PTMG type thermoplastic polyurethane available from Bayer Polymer.

Trade name "Nucrel AN4318": A terpolymer available from DuPont-Mitsui Polychemicals Co., Ltd.

Polyisocyanate compound: 4,4' -Diphenylmethane diisocyanate

Thermoplastic elastomer: Available under the trade name "Hytrel 4001" from DuPont-Toray Co., Ltd.

Titanium oxide: Available under the trade name "Tipaque R550" from Ishihara Sangyo Kaisha, Ltd.

Polyethylene wax: Available under the tradename "Sanwax 161P" from Sanyo Chemical Industries, Ltd.

Simultaneous with injection molding of the cover, numerous dimples were formed on the surface of the cover, after which the cover was spray-painted. In each example and comparative example, the dimples were formed in such a way that, after painting, they satisfied the parameters shown in Tables 3 to 7 below. In the tables, the dimple types designated as Da refer to dimples having a diameter of 3.7 mm or more, and the dimple types designated as Db refer to dimples having a diameter of less than 3.7 mm.

Figure 3:
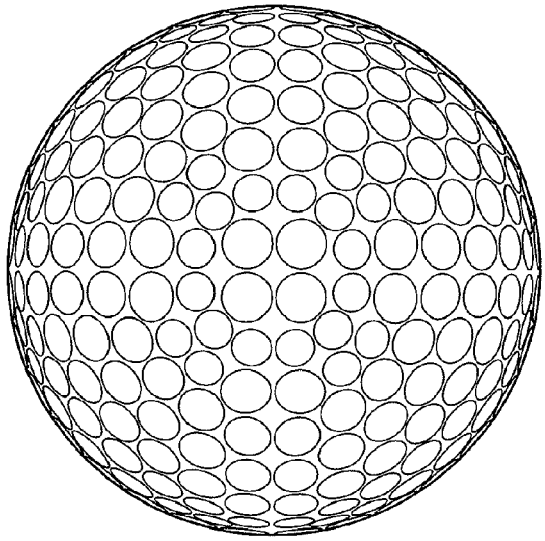
FIG. 3 is a top view of a ball showing a dimple pattern (I) used in an example of the invention.
Figure 4:
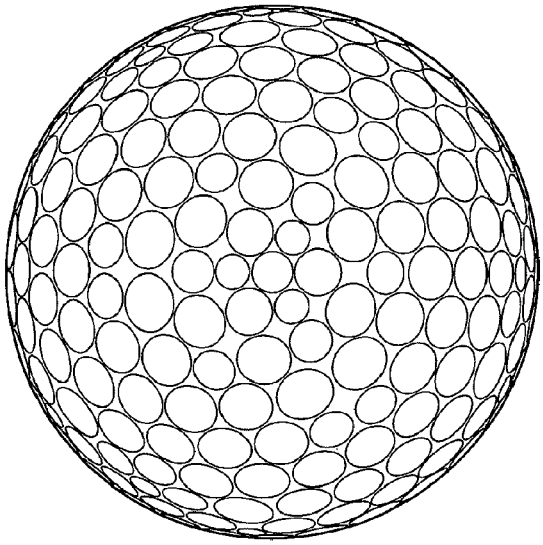
FIG. 4 is a top view of a ball showing a dimple pattern (II) used in a comparative example.
Figure 5:
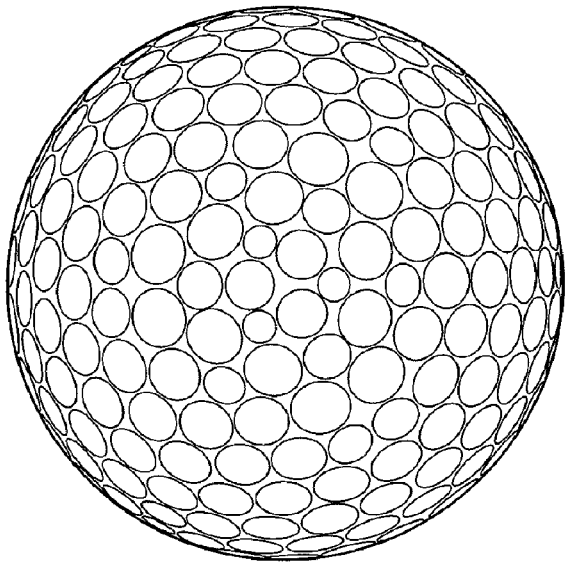
FIG. 5 is a front view of a ball showing a dimple pattern (III) used in a comparative example.
Figure 6:
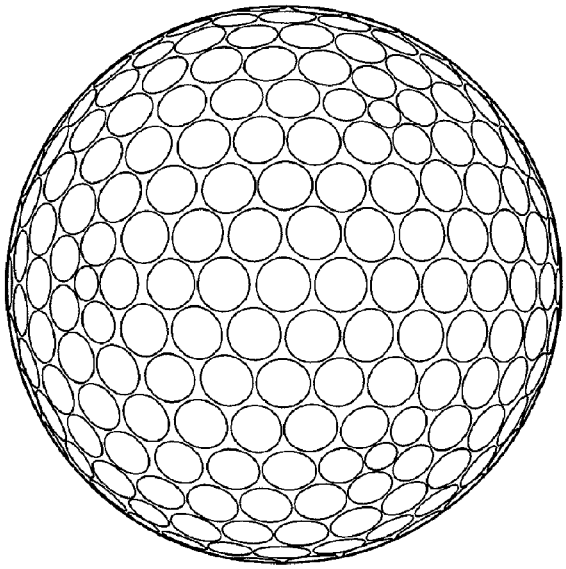
FIG. 6 is a front view of a ball showing a dimple pattern (IV) used in a comparative example.
Figure 7:
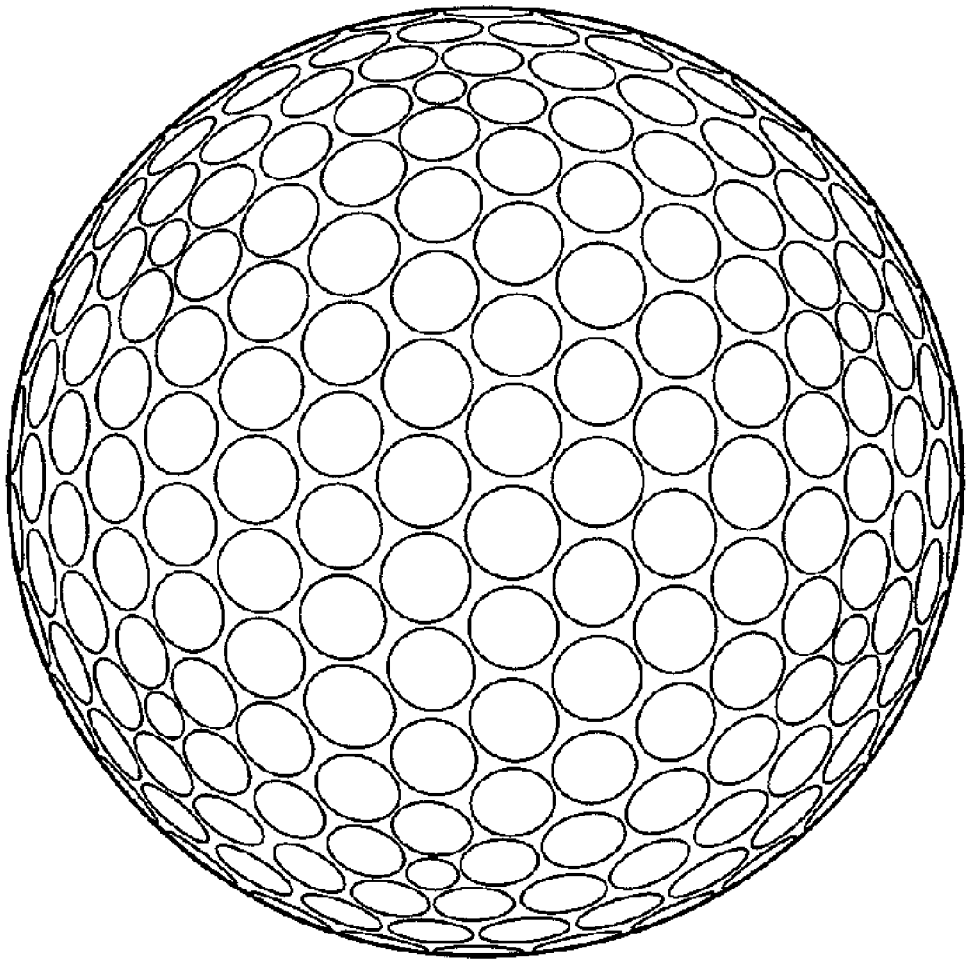
FIG. 7 is a front view of a ball showing a dimple pattern (V) used in a comparative example.

With regard to the dimple patterns in the tables, the dimple pattern for Examples 1 to 3 is shown in Table 3 (FIG. 3), the pattern for Comparative Example 1 is shown in Table 4 (FIG. 4), the pattern for Comparative Example 2 is shown in Table 5 (FIG. 5), the pattern for Comparative Example 3 is shown in Table 6 (FIG. 6), the pattern for Comparative Example 4 is shown in Table 7 (FIG. 7), and the pattern for Comparative Example 5 is shown in Table 3 (FIG. 3). These figures are all top views of the ball. In each example, the bottom views have the same pattern as the top views, and are thus omitted.

TABLE 3

| Dimple type | Number of dimples | Diameter (mm) | Depth (mm) | Volume ($mm^3$) |
|---|---|---|---|---|
| Da-I | 40 | 4.1 | 0.21 | 1.53 |
| Da-II | 184 | 3.9 | 0.20 | 1.31 |
| Db-I | 96 | 3.3 | 0.16 | 0.73 |
| Da-III | 32 | 4.1 | 0.23 | 1.72 |
| Da-IV | 16 | 3.9 | 0.22 | 1.45 |
| Db-II | 16 | 3.2 | 0.15 | 0.62 |
| Db-III | 8 | 3.2 | 0.14 | 0.49 |

TABLE 4

| Dimple type | Number of dimples | Diameter (mm) | Depth (mm) | Volume ($mm^3$) |
|---|---|---|---|---|
| Da-I | 24 | 4.7 | 0.15 | 1.25 |
| Da-II | 168 | 4.5 | 0.15 | 1.15 |
| Da-III | 48 | 3.9 | 0.15 | 0.85 |
| Db-I | 12 | 2.9 | 0.15 | 0.44 |
| Db-II | 12 | 2.6 | 0.11 | 0.24 |
| Da-IV | 30 | 4.4 | 0.16 | 1.20 |
| Da-V | 36 | 3.9 | 0.17 | 0.94 |
| Db-III | 8 | 3.5 | 0.16 | 0.70 |
| Db-IV | 6 | 3.4 | 0.15 | 0.61 |

TABLE 5

| Dimple type | Number of dimples | Diameter (mm) | Depth (mm) | Volume ($mm^3$) |
|---|---|---|---|---|
| Da-I | 12 | 4.6 | 0.16 | 1.28 |
| Da-II | 222 | 4.4 | 0.16 | 1.16 |
| Da-III | 36 | 3.8 | 0.15 | 0.80 |
| Db-I | 12 | 2.6 | 0.12 | 0.58 |
| Da-IV | 12 | 4.4 | 0.17 | 0.25 |
| Da-V | 24 | 3.8 | 0.16 | 1.25 |
| Db-II | 6 | 3.5 | 0.16 | 0.86 |
| Db-III | 6 | 3.4 | 0.15 | 0.7 |

TABLE 6

| Dimple type | Number of dimples | Diameter (mm) | Depth (mm) | Volume ($mm^3$) |
|---|---|---|---|---|
| Da-I | 228 | 4.3 | 0.17 | 1.06 |
| Da-II | 36 | 3.7 | 0.16 | 0.74 |
| Db-I | 12 | 2.5 | 0.12 | 0.23 |

TABLE 6-continued

| Dimple type | Number of dimples | Diameter (mm) | Depth (mm) | Volume ($mm^3$) |
|---|---|---|---|---|
| Db-II | 12 | 3.4 | 0.17 | 0.72 |
| Da-III | 42 | 4.3 | 0.18 | 1.14 |
| Da-IV | 24 | 3.7 | 0.17 | 0.80 |
| Da-V | 12 | 4.3 | 0.17 | 1.05 |
| Da-VI | 2 | 3.9 | 0.16 | 0.89 |

TABLE 7

| Dimple type | Number of dimples | Diameter (mm) | Depth (mm) | Volume ($mm^3$) |
|---|---|---|---|---|
| Db-I | 114 | 3.65 | 0.196 | 1.071 |
| Da-I | 114 | 4.0 | 0.153 | 1.013 |
| Db-II | 60 | 3.65 | 0.195 | 1.071 |
| Db-III | 12 | 2.5 | 0.167 | 0.431 |
| Da-II | 60 | 4.0 | 0.153 | 1.013 |

Various properties of the resulting two-piece solid golf balls were investigated based on the following criteria. The results are shown in Table 8.

Deflection of Solid Core and Finished Product

Using a model 4204 test system manufactured by Instron Corporation, the solid cores and the finished products were each compressed at a rate of 10 mm/min, and the difference between the deflection under a load of 10 kg and the deflection under a load of 130 kg was measured.

Core Surface Hardness

The Shore D hardness at the surface of the core was measured.

Measurements of the cross-sectional and surface hardnesses were carried out at two places each on N=5 specimens. The Shore D hardnesses were values measured in accordance with ASTM D-2240 after temperature conditioning at 23° C.

Cover Material Hardness (Shore D)

The cover composition was formed to a thickness of about 2 mm with a hot press and the resulting sheet was held at 23° C. for 2 weeks, following which the hardness of the sheet was measured in accordance with ASTM D2240.

Low-Velocity CL Ratio

The low-velocity CL ratio was obtained by calculating the ratio of the coefficient of lift CL of a ball launched using an Ultra Ball Launcher (UBL) at a Reynolds number of 70,000 and a spin rate of 2000 rpm with respect to the coefficient of lift CL of a ball launched at a Reynolds number of 80,000 and a spin rate of 2000 rpm.

Flight Performance

Ball striking tests were carried out at a head speed (HS) of 45 m/s using a TOURSTAGE X-DRIVE club (loft angle, 9.5°) mounted on a swing robot, in such a way as to generate spin rates of about 2200 rpm and about 3300 rpm.

TABLE 8

| | | Example | | | Comparative Example | | | | |
|---|---|---|---|---|---|---|---|---|---|
| | | 1 | 2 | 3 | 1 | 2 | 3 | 4 | 5 |
| Core | Formulation | A | B | C | A | A | A | A | D |
| | Diameter (mm) | 39.3 | 38.5 | 40.9 | 39.3 | 39.3 | 39.3 | 39.3 | 39.3 |
| | Deflection (mm) | 2.8 | 4.4 | 4.4 | 2.8 | 2.8 | 2.8 | 2.8 | 1.8 |
| | Surface hardness (Shore D) | 55 | 44 | 44 | 55 | 55 | 55 | 55 | 55 |
| Cover | Material | F | E | F | F | F | F | F | F |
| | Hardness (Shore D) | 48 | 57 | 48 | 48 | 48 | 48 | 48 | 48 |
| | Thickness (mm) | 1.7 | 2.1 | 0.9 | 1.7 | 1.7 | 1.7 | 1.7 | 1.7 |

TABLE 8-continued

| | | | Example | | | Comparative Example | | | | |
|---|---|---|---|---|---|---|---|---|---|---|
| | | | 1 | 2 | 3 | 1 | 2 | 3 | 4 | 5 |
| Dimples | Number of dimple types | | 7 | 7 | 7 | 9 | 8 | 8 | 5 | 7 |
| | Number of dimples | | 392 | 392 | 392 | 344 | 330 | 368 | 360 | 392 |
| | SR value (%) | | 72 | 72 | 72 | 80 | 78 | 76 | 71 | 72 |
| | VR value (%) | | 1.2 | 1.2 | 1.2 | 0.9 | 0.88 | 0.93 | 0.9 | 1.2 |
| | Average DP (mm) | | 0.19 | 0.19 | 0.19 | 0.15 | 0.15 | 0.16 | 0.17 | 0.19 |
| | Average DM/DP | | 19.83 | 19.83 | 19.83 | 27.39 | 24.77 | 23.17 | 20.97 | 19.83 |
| | (Total number of Db)/(Total number of Da) | | 0.44 | 0.44 | 0.44 | 0.12 | 0.078 | 0.07 | 1.07 | 0.44 |
| | Volume proportion of Da dimples (%) | | 82 | 82 | 82 | 95 | 95 | 97 | 48 | 82 |
| | Low-velocity CL ratio (%) | | 85 | 85 | 85 | 80 | 78 | 65 | 75 | 85 |
| Ball | Diameter (mm) | | 42.7 | 42.7 | 42.7 | 42.7 | 42.7 | 42.7 | 42.7 | 42.7 |
| | Weight (g) | | 45.3 | 45.3 | 45.3 | 45.3 | 45.3 | 45.3 | 45.3 | 45.3 |
| | Deflection (mm) | | 2.7 | 3.7 | 4.5 | 2.7 | 2.7 | 2.7 | 2.7 | 1.8 |
| Flight | HS 45 m/s, 2200 rpm | Carry (m) | 213.9 | 212.1 | 210.6 | 216.2 | 215.3 | 213.6 | 212.8 | 216 |
| | | Total distance (m) | 220.5 | 220.2 | 219.2 | 223.0 | 222.3 | 220.4 | 219.9 | 222.9 |
| | HS 45 m/s, 3300 rpm | Carry (m) | 213.6 | 211.5 | 210.5 | 214.9 | 213.9 | 212.1 | 210.8 | 214.7 |
| | | Total distance (m) | 219.9 | 219.5 | 218.5 | 220.9 | 220.1 | 218.1 | 217.2 | 219.1 |
| | Difference in carry (m) | | 0.3 | 0.6 | 0.1 | 1.3 | 1.4 | 1.5 | 2.0 | 1.3 |
| | Difference in total distance (m) | | 0.6 | 0.7 | 0.7 | 2.1 | 2.2 | 2.3 | 2.7 | 3.8 |

As shown in the above table, compared with each of the golf balls in Comparative Examples 1 to 5, the two-piece solid golf balls in Examples 1 to 3 of the invention exhibited low variations in carry and total distance at both high and low spin rates, and were able to achieve a stable trajectory.

The invention claimed is:

1. A two-piece solid golf ball comprising a solid core and a cover which encases the core and has formed on an outside surface thereof a plurality of dimples, wherein the solid core has a diameter of from 35 to 44 mm, a deflection when compressed under a final load of 130 kgf from an initial load of 10 kgf of from 2.0 to 6.0 mm, and a surface hardness in Shore D units of from 25 to 65; the cover has a thickness of from 0.5 to 5.0 mm and a material hardness in Shore D units of from 30 to 70; and the number of dimples is from 250 to 500, the dimples have a surface coverage (SR) of at least 70% and a volume ratio (VR) of at least 1.0%, are of at least three types and have an average depth of at least about 0.18 mm and a diameter-to-depth ratio (DM/DP) of not more than about 23; and the ball has a coefficient of lift CL at a Reynolds number of 70,000 and a spin ratio of 2,000 rpm which is maintained at 60% or more of the coefficient of lift CL at a Reynolds number of 80,000 and a spin rate of 2,000, wherein the depth of a dimple is measured by connecting positions where the dimple meets land areas to trace a hypothetical flat plane L and determining the vertical distance from a center position on the flat plane L to a deepest portion of a bottom of the dimple.

2. The two-piece solid golf ball of claim 1, wherein dimples Da having a diameter of at least 3.7 mm account for at least about 75% of the total dimple volume.

3. The two-piece solid golf ball of claim 1 wherein, letting Da represent dimples having a diameter of at least 3.7 mm and Db represent dimples having a diameter of less than 3.7 mm, the ratio (total number of Db)/(total number of Da) is at least about 0.005 and not more than about 1.

4. The two-piece solid golf ball of claim 1, wherein the average diameter (Dm) of the Da dimples is at least about 3.7 mm and not more than about 6 mm, the average diameter (Dm) of the Db dimples is at least about 1 mm and not more than about 3.7 mm.

5. The two-piece solid golf ball of claim 1, wherein the average depth (Dp) of the Da dimples is at least about 0.05 mm and not more than about 0.5 mm, the average depth (Dp) of the Db dimples is at least about 0.05 mm and not more than about 0.3 mm.

6. The two-piece solid golf ball of claim 1, wherein the average volume of the Da dimples is at least about 0.8 $mm^3$ and not more than about 3.0 $mm^3$, the average volume of the Db dimples is at least about 0.2 $mm^3$ and not more than about 1.5 $mm^3$.

7. The two-piece solid golf ball of claim 1, wherein the ratio Dm/Dp for the Da dimples is at least about 7 and not more than about 25.

8. The two-piece solid golf ball of claim 1, wherein the ratio Dm/Dp for the Db dimples is at least about 10 and not more than about 30.

9. The two-piece solid golf ball of claim 1, wherein the cover layer is formed primarily of a resin mixture comprising:

(A) a thermoplastic polyurethane material, (B) an isocyanate mixture obtained by dispersing (b-1) an isocyanate compound having as functional groups at least two isocyanate groups per molecule in (b-2) a thermoplastic resin that is substantially non-reactive with isocyanate.

10. The two-piece solid golf ball of claim 1 wherein the cover layer is formed primarily of a resin mixture comprising:

(D) a thermoplastic polyurethane, (E) a polyisocyanate compound.

* * * * *